US006880232B2

(12) United States Patent
La Valle et al.

(10) Patent No.: US 6,880,232 B2
(45) Date of Patent: Apr. 19, 2005

(54) METHOD OF MAKING AN ELECTRICAL INDUCTOR USING A SACRIFICIAL ELECTRODE

(75) Inventors: Al La Valle, Beaverton, OR (US); Patrick D. Boyd, Aloha, OR (US); Jarett Rinaldi, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 47 days.

(21) Appl. No.: 09/963,055

(22) Filed: Sep. 26, 2001

(65) Prior Publication Data

US 2003/0058074 A1 Mar. 27, 2003

(51) Int. Cl.[7] ..... H01F 7/06
(52) U.S. Cl. ..... 29/602.1; 336/83
(58) Field of Search ..... 336/65, 83, 90, 336/92, 96, 192, 199, 200, 220, 221, 222, 223, 232, 233; 29/602.1, 604, 605, 606, 837

(56) References Cited

FOREIGN PATENT DOCUMENTS

| | | |
|---|---|---|
| DE | 3607025 | * 9/1987 |
| JP | 57-068008 | * 4/1982 |
| JP | 04-361504 | * 12/1992 |

* cited by examiner

*Primary Examiner*—Tuyen T Nguyen
(74) *Attorney, Agent, or Firm*—Schwegman, Lundberg, Woessner & Kluth, P.A.

(57) ABSTRACT

A method for forming electronic inductors. A model of the desired shape of the inductor is first formed in wax or other soft material. It is compressed in a block of magnetically permeable material and then heated to remove the wax shape. The resultant cavity in the shape of the inductor is filled with conductive material to form an inductor within the magnetically permeable material block.

13 Claims, 3 Drawing Sheets

METHOD OF MAKING AN ELECTRICAL INDUCTOR USING A SACRIFICIAL ELECTRODE

FIELD

The present invention is directed to a method for making an electrical inductor. More particularly, the present invention is directed to a method of making an electrical inductor using a lost wax method.

BACKGROUND

Inductors have always been one of the basic components of electrical circuitry and are still commonly used even with current generations of microprocessors. There is a great advantage when designing microprocessors and other circuitry to be able to choose an inductor having desirable characteristics from a catalog of inductors having different values for a number of different parameters. For example, in designing current switch mode power supplies, there are three major components, inductors, storage capacitors and power MOSFETs (Metal Oxide Semiconductor Field Effect Transistors). By utilizing high performance inductors having specific values of parameters, it may be possible to use a less expensive MOSFET or a MOSFET that switches at a lower frequency. Alternatively, a smaller power supply overall may be produced or a power supply that uses less power and generates less heat. It may also allow fewer phases in the power supply design due to a high performance inductor.

However, in order to have inductors with these different performance values, it is often necessary to either vary the cross section of the wire used in the inductor or to vary the shape of the coil within the inductor. In addition, in changing the shape of the coil, it is possible to minimize the wasted space inside the inductor body and to optimize current handling capabilities and EMI (Electro Magnetic Interference) characteristics.

The predominant method of forming an inductor currently is to use enamel coated copper wire formed into a round coil shape. This coil may be placed in magnetically permeable powder material which is then compressed into a block or may be placed in a preformed two piece case made of similar magnetically permeable material. It is necessary to have an enamel coating on the wire because the coil comes into contact with itself. Currently, the most popular shape is a round shaped coil which leaves wasted space when placed in a square package. Another alternative is to wrap enamel coated wire around a donut shaped core made from magnetically permeable material.

These and other currently available methods of making inductors are not completely satisfactory. Forming shaped coils other than round or donut shaped is more difficult. Also, the use of other than round cross-sectional shaped wires is not convenient. Thus, it is difficult to obtain a coil having unusual characteristics because of the limitations on the shape of the coil and the wire.

A method of making jewelry and other cast metal pieces known as the "lost wax method" has been known for perhaps over 5,000 years. This method utilizes the formation of the desired object first in a soft material such as wax. A material such as plaster is then cast around the wax model and allowed to dry. The entire object is heated so as to melt the wax but not harm the plaster surrounding it. The wax is allowed to run off leaving a hole in the mold in the same shape of the original wax object. Metal is then poured in this opening to form the desired object in the same shape as the original wax form. Since the original wax material is easier to work, it allows the jeweler to form complex shapes relatively easily. Once the metal object is cooled, the plaster cast is removed and the final metal object is polished and otherwise finished to form the finished jewelry object. While this method has been used to make many devices, it has not been utilized for electronic devices such as electronic inductors.

BRIEF DESCRIPTION OF THE DRAWINGS

The foregoing and a better understanding of the present invention will become apparent from the following detailed description of example embodiments and the claims when read in connection with the accompanying drawings, all forming a part of the disclosure of this invention. While the foregoing and following written and illustrated disclosure focuses on disclosing example embodiments of the invention, it should be clearly understood that the same is by way of illustration and example only and that the invention is not limited thereto. The spirit and scope of the present invention are limited only by the terms of the appended claims.

The following represents brief descriptions of the drawings, wherein.

DETAILED DESCRIPTION

Figure 1:
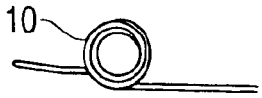
FIG. 1 is an example background arrangement useful in gaining a more thorough understanding of the present invention.

Before beginning a detailed description of the subject invention, mention of the following is in order. When appropriate, like reference numerals and characters may be used to designate identical, corresponding or similar components in differing figure drawings. Figures are generally not drawn to scale.

Figure 2:
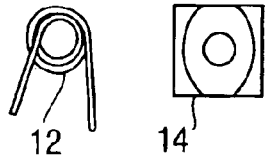
FIG. 2 is an example background arrangement useful in gaining a more thorough understanding of the present invention.
Figure 3:
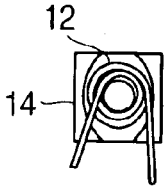
FIG. 3 is an example background arrangement useful in gaining a more thorough understanding of the present invention.

Turning now to the drawings, FIGS. 1–4 show electronic inductors made according to currently available methods. Thus, in each of these figures, enamel coated copper wire is used. In FIG. 1, the wire is formed into a round coil shape 10. This type of coil may be compressed into a block of magnetically permeable material by compressing powder around it. A gap is provided as a distributed airgap in the powder. FIG. 2 shows a similar coil 12 with a preformed case made of magnetically permeable material 14. As shown in FIG. 3, the coil 12 is placed into the case 14. Another section of the case (not shown) is then placed over the coil so the coil is completely enclosed by the magnetically permeable material. A gap is provided as a mechanical air gap between the center of case 14 and the case section not shown.

Figure 4:
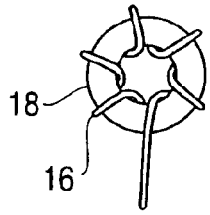
FIG. 4 is an example background arrangement useful in gaining a more thorough understanding of the present invention.

FIG. 4 shows another arrangement of the distributed gap type wherein the enamel coated wire 16 is wound around a donut shaped core 18 made of compressed iron powder.

While these prior art devices are simple and perform adequately, they do not allow for variation in the inductor characteristics which are obtainable through unique electrode shapes. Specifically, they do not easily allow for variations in the cross-sectional shape or the shape of the coil.

The present invention is designed to produce electronic inductors which may have different configurations so as to optimize volumetric efficiency, current handling capability and other electrical characteristics such as AC (Alternating Current) resistance, DCR (Direct Current Resistance) and Q(Quality Factor). With the present invention, the coil can be designed with almost any shape required for optimum performance, and the wire cross sectional shape also may be any shape. The enamel coating is also unnecessary. It is also possible to vary the size and shape of the wire within a single inductor.

In order to accomplish this, the basic methods of the lost wax method are utilized. First, a sacrificial electrode is fabricated in a material such as plastic, wax, carbon paste or other material which can be melted or burned by heating. The size and shape of the wire and the shape of the coil can be any desired shape to attain the characteristics desired. The sacrificial coil is then surrounded by a block of magnetically permeable material with the ends of the sacrificial electrode reaching the outside of the block. The entire block is heated so as to melt or burn out the wax or other material formed as the sacrificial material. Alternatively, other methods could be used such as a chemical etchant or even a mechanical removal method if the shape will allow that. However, whichever method is utilized to remove the sacrificial electrode, it must be done without affecting the magnetically permeable material. Once the sacrificial electrode has been removed, a hollow cavity is formed in the same shape as the desired coil. This cavity can then be filled with an electrically conductive material such as molten solder or other molten metals. It could also be filled with a liquid, paste or powder form of other electrically conductive materials. It is even possible to first form a skin of one type of material on the inner walls of the hollow cavity for the outer surface of the coil using electroplating techniques or other similar methods so that a highly conductive material such as a very thin layer of gold or other precious metal can form the skin of the electrode and the core of the electrode can then be filled with a base metal. The result would be a coil wire with a solid core of copper, lead or solder to handle the DC (Direct Current) component with a highly conductive thin outer skin for the AC component. Where the two ends of the coil exit the block of magnetically permeable material, a terminal is applied so as to make the unit easily soldered to a circuit board. This can be done by any of the currently available methods such as applying solder paste, electroplating, vacuum metal deposition or physically attaching metal pads.

Figure 5:
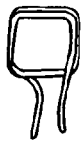
FIGS. 5–9 are example advantageous embodiments of inductors using the present invention.
Figure 6:
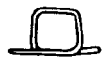
Figure 7:
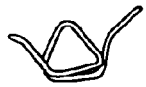
Figure 8:
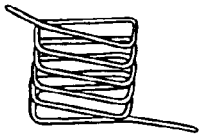
Figure 9:
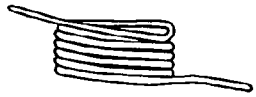

FIGS. 5–9 show various forms of coils formed using the present invention. In particular, FIGS. 5 and 6 show square coils viewed along the axis of the coil. Such a square shape would fit better into a case such as shown in FIGS. 2 and 3 because of the shape of the coil. FIG. 7 shows a similar coil, but in a triangular shape. FIGS. 8 and 9 show side views of such coils with FIG. 8 showing a coil with larger separations between turns of the coil which affords the characteristic of lower parasitic capacity.

Because the wax sacrificial electrode can be easily worked, it is possible to form it into the shape of a wire which may be other than round in cross section. It would even be possible to vary the shape of the wire in different places in the coil or to vary the diameter of the wire which has the same shape, depending on the characteristics desired in the coil. Likewise, the shape of the coil can vary in any manner, depending on the characteristics that are desired. Of course, the method is equally applicable to common shaped coils such as a simple round coil using round cross-sectional wires such as shown in FIGS. 1–3.

Figure 10:
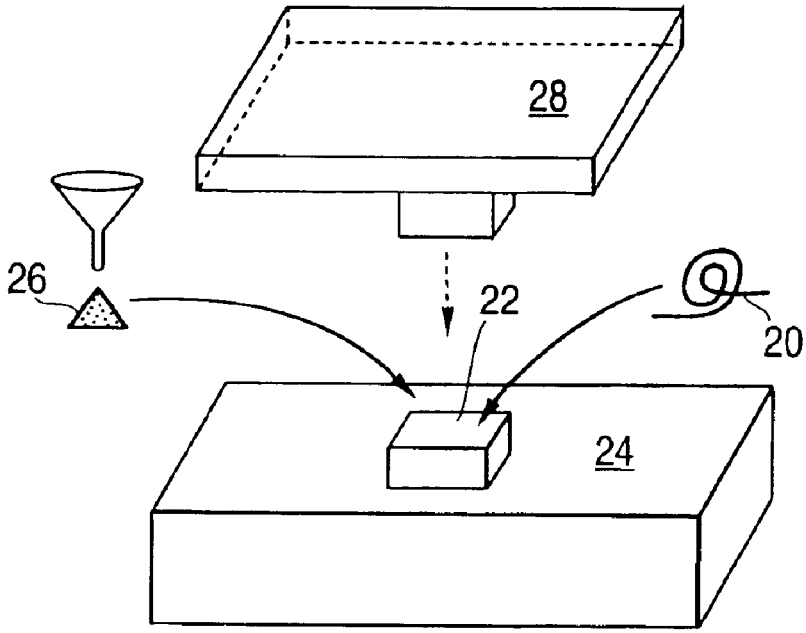
FIG. 10 is a diagram of apparatus which may be used to perform the present invention.

FIG. 10 shows an apparatus which may be used in the method of the present invention. The sacrificial coil 20 is first formed from wax or other removable material. The coil is placed in a cavity 22 in a molding block 24. Powdered magnetically permeable material such as iron powder 26 is placed in cavity 22 so as to surround the coil 20 on all sides. However, the ends of the coil should be in contact with the edges of the cavity so that the material can be removed and the permanent material can be reinserted afterwards. A press 28 compresses the powder within the molding cavity so as to form a solid block with the sacrificial coil inside. Although only one side of the press is shown, a similarly shaped press could also be applied from the other side. After the powder is compressed, the final product may be removed either by removing the molding block or by pushing the product out from one side.

Figure 11:
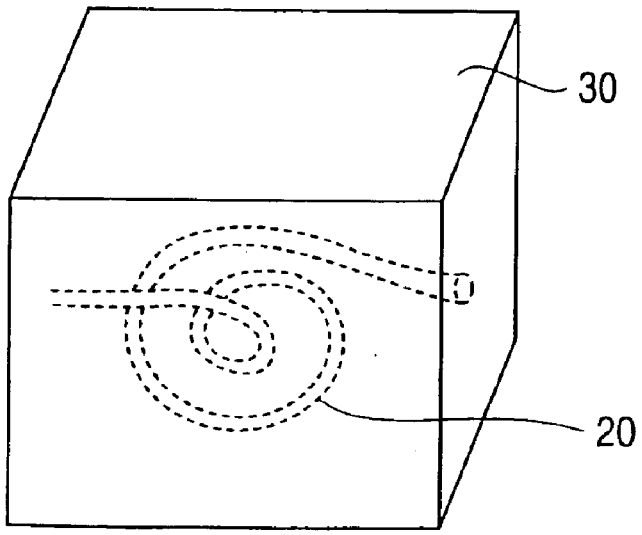
FIG. 11 is an example of the product formed using the present invention.

FIG. 11 shows the product formed after the molding process. The sacrificial coil 20 is embedded in a block of magnetically permeable material 30, which may be iron powder or other similar materials. Both ends of the sacrificial coil are in contact with faces of the block for easy removal of the wax and easy insertion of the final conductive material.

Figure 12:
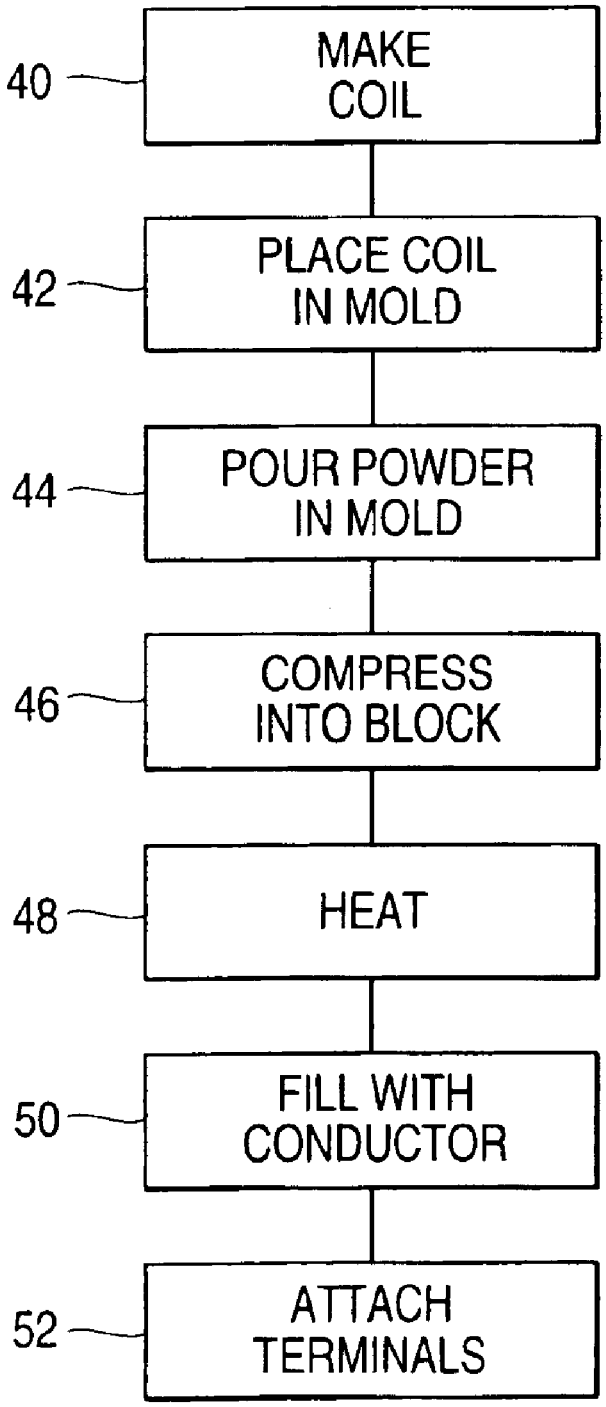
FIG. 12 is a flow chart showing the steps of the present invention.

FIG. 12 is a flow chart showing the steps of the present inventive method. In step 40 the sacrificial coil is made from wax, plastic, compressed carbon or other material with the shape of the coil and the cross sectional shape of the wire being made to vary as desired. It is material which is relatively soft and easy to shape. In step 42, the coil is placed into the cavity of a mold with its ends touching the faces of the cavity or otherwise made so that exit holes are formed. In step 44 an iron powder or ferrite or other magnetically permeable material is placed in the cavity so as to surround the sacrificial coil. In step 46, a piston compresses the powder into a solid block. It is also possible to add a binder to the powder to assist the integrity of the block. In step 48, the block is subject to a high temperature so that the sacrificial coil is melted, burned or otherwise removed. In step 50, the hollow cavity remaining in the block is filled with a conductive material such as molten lead, molten solder, other molten metals or conductive powders. In step 52, terminals are attached to the ends of the conductive coil ends.

It would also be possible to have an additional step between steps 48 and 50 whereby the inside wall of the cavity is treated with a precious metal by electroplating or other method before adding the base material so as to have increased conductivity along the skin of the final electrode.

In concluding, reference in the specification to "one embodiment", "an embodiment", "example embodiment", etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments. Furthermore, for ease of understanding, certain method procedures may have been delineated as separate procedures; however, these separately delineated procedures should not be construed as necessarily order dependent in their performance, i.e., some procedures may be able to be performed in an alternative ordering, simultaneously, etc.

This concludes the description of the example embodiments. Although the present invention has been described with reference to a number of illustrative embodiments thereof, it should be understood that numerous other modifications and embodiments can be devised by those skilled in the art that will fall within the spirit and scope of the principles of this invention. More particularly, reasonable variations and modifications are possible in the component parts and/or arrangements of the subject combination arrangement within the scope of the foregoing disclosure, the drawings and the appended claims without departing from the spirit of the invention. In addition to variations and modifications in the component parts and/or arrangements, alternative uses will also be apparent to those skilled in the art.

What is claimed is:

1. A method of making an inductor comprising:

forming an element in a desired shape from sacrificial material;

surrounding said element with material to form a molding block;

removing said element from said block while leaving a cavity in said block in the shape of said element; and filling said cavity in said block with a conductive material so as to form an inductor made of conductive material in said material block.

2. The method according to claim 1, wherein said sacrificial material is one of wax, plastic and compressed carbon.

3. The method according to claim 1, wherein said material is one or iron powder and ferrite.

4. The method according to claim 1, wherein said surrounding with material includes placing said element in a mold cavity, dispensing magnetically permeable material in the form of a powder into said mold cavity and compressing said powder to form a block.

5. The method according to claim 1, wherein said removing said element comprising heating said block.

6. The method according to claim 1, wherein said element is removed by chemical means.

7. The method according to claim 1, further comprising at least one of lead, solder, molten metal and conductive powder as the conductive material.

8. A method of making an inductor comprising:

forming an element in a desired shape from sacrificial material;

surrounding said element with material to form a molding block;

removing said element from said block while leaving a cavity in said block in the shape of said element;

forming a thin layer of highly conductive material on walls on said cavity; and filling a remainder of said cavity in said block with a conductive material so as to form an inductor made of conductive material in said material block.

9. The method according to claim 8, wherein said forming a thin layer is accomplished by electroplating.

10. The method according to claim 8, wherein said thin layer is made of gold.

11. The method according to claim 8, wherein said conductive material is selected for an ability to handle a DC component of an applied signal to flow through said conductive material while said thin material is selected for an ability to handle an AC component of said signal to flow in said thin layer.

12. The method according to claim 1, wherein the molding block is made of a magnetically permeable material.

13. The method according to claim 8, wherein the molding block is made of a magnetically permeable material.

* * * * *